US006254225B1

(12) United States Patent
Chwalek et al.

(10) Patent No.: US 6,254,225 B1
(45) **Date of Patent: *Jul. 3, 2001**

(54) CONTINUOUS INK JET PRINTER WITH ASYMMETRIC HEATING DROP DEFLECTION

(75) Inventors: James M. Chwalek, Pittsford; David L. Jeanmaire, Brockport; Constantine N. Anagnostopoulos, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/544,688

(22) Filed: Apr. 7, 2000

Related U.S. Application Data

(63) Continuation-in-part of application No. 08/954,317, filed on Oct. 17, 1997, now Pat. No. 6,079,821.

(51) Int. Cl.[7] ..... B41J 2/105
(52) U.S. Cl. ..... 347/82
(58) Field of Search ..... 347/73, 74, 75, 347/77, 78, 82

(56) References Cited

U.S. PATENT DOCUMENTS

| | | | |
|---|---|---|---|
| 1,941,001 | 12/1933 | Hansell | 178/96 |
| 3,287,734 | 11/1966 | Kazan | 347/53 |
| 3,373,437 | 3/1968 | Sweet et al. | 347/74 |
| 3,416,153 | 12/1968 | Hertz et al. | 347/73 |
| 3,709,432 | 1/1973 | Robertson | 239/4 |
| 3,878,519 | 4/1975 | Eaton | 347/75 |
| 3,916,421 | 10/1975 | Hertz | 347/73 |
| 3,979,756 | 9/1976 | Helinski et al. | 347/75 |
| 4,070,679 | 1/1978 | Fan et al. | 347/75 |
| 4,148,718 | 4/1979 | Fulwyler | 209/3.1 |
| 4,230,558 | 10/1980 | Fulwyler | 209/3.1 |
| 4,318,483 | 3/1982 | Lombardo et al. | 347/483 |
| 4,346,387 | 8/1982 | Hertz | 347/75 |
| 4,555,713 * | 11/1985 | Ishima et al. | 347/77 |
| 4,646,106 | 2/1987 | Howkins | 347/9 |
| 5,160,939 | 11/1992 | Bajeux et al. | 347/78 |
| 5,841,452 | 11/1998 | Silverbrook | 347/47 |
| 5,966,154 * | 10/1999 | Deboer | 347/82 |
| 6,079,821 * | 6/2000 | Chwalek et al. | 347/82 |

FOREIGN PATENT DOCUMENTS

| | | |
|---|---|---|
| 56-21866 | 2/1981 | (JP) . |

* cited by examiner

*Primary Examiner*—N. Le
*Assistant Examiner*—Anh T. N. Vo
(74) *Attorney, Agent, or Firm*—Walter S. Stevens

(57) ABSTRACT

A method for controlling a terminal flow of ink droplets from the nozzle of an ink jet printer at the end of a printing operation is provided. The printer has a first heating element disposed on one side of the nozzle that is selectively actuated to direct ink droplets away from a recording medium and into an ink gutter during a printing operation. The printer also has a second heating element disposed on the side of the nozzle opposite from the first heating element. After the first heating element applies its last operational heat pulse to the printing nozzle at the end of a printing operation, the second heating element applies at least one deflection correcting heat pulse of the same duration, magnitude and period as the last operational heat pumps. The method prevents ink droplets generated after the end of a printing operation from erroneously striking the printing medium.

15 Claims, 5 Drawing Sheets

CONTINUOUS INK JET PRINTER WITH ASYMMETRIC HEATING DROP DEFLECTION

CROSS REFERENCE TO RELATED APPLICATIONS

This application is a continuation-in-part of U.S. patent application Ser. No. 08/954,317 filed Oct. 17, 1997, now U.S. Pat. No. 6,079,821 and assigned to the Eastman Kodak Company.

FIELD OF THE INVENTION

This invention generally relates to a method of supplying power to a continuous ink jet printhead that maintains a proper directionality of a stream of droplets at the end of a printing operation.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical presses, even though this conventional method requires very expensive set up and is seldom commercially viable unless a few thousand copies of a particular page are to be printed. Thus, there is a need for improved digitally controlled printing systems that are able to produce high quality color images at a high speed and low cost using standard paper.

Ink jet printing is a prominent contender in the digitally controlled electronic printing arena because, e.g., of its non-impact. low-noise characteristics, its use of plain paper, and its avoidance of toner transfers and fixing. Ink jet printing mechanisms can be categorized as either continuous ink jet or drop on demand ink jet. Continuous ink jet printing dates back to a least 1929. See U.S. Pat. No. 1,941,001 to Hansell.

Conventional continuous ink jets utilize electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium.

A novel continuous ink jet printer is described and claimed in U.S. patent application Ser. No. 08/954,317 filed Oct. 17, 1997, now U.S. Pat. No. 6,079,821 and assigned to the Eastman Kodak Company. Such printers use asymmetric heating in lieu of electrostatic charging tunnels to deflect ink droplets toward desired locations on the recording medium. In this new device, a droplet generator formed from a heater having a selectively-actuated section associated with only a portion of the nozzle bore perimeter is provided for each of the ink nozzle bores. Periodic actuation of the heater element via a train of uniform electrical power pulses creates an asymmetric application of heat to the stream of droplets to control the direction of the stream between a print direction and a non-print direction.

While such continuous ink jet printers have demonstrated many proven advantages over conventional ink jet printers utilizing electrostatic charging tunnels, the inventors have noted certain areas in which such printers may be improved. In particular, the inventors have noted that at the end of a printing operation, the next droplet or droplets directed toward the gutter may be directed toward the printing medium instead. While the cause of such droplet misdirection is not entirely understood, the applicants speculate that the principal cause is the non-instantaneous thermal response time of the heated portion of the nozzle to cool back to ambient temperature. Since the amount of the drop deflection is directly related to the temperature of the ink, and since the heated half of the ink jet nozzle does not cool instantaneously, applicants speculate that, after the end of a printing operation, the first ink droplet formed is misdirected away from the ink gutter and toward the printing medium due to the residual heat of the ink jet nozzle. Whether or not the second or third subsequent droplets are similarly misdirected is dependent upon the residual heat of the print head in the vicinity of the nozzles, the viscosity and thermal properties of the ink, and other thermal and fluid dynamic factors. Any such misdirected droplets can interfere with the objective of obtaining high image quality printing from such devices.

SUMMARY OF THE INVENTION

It is an object of the present invention to provide a continuous ink jet method of printing that maximizes print resolution by preventing the misdirection of ink droplets at the end of a printing operation.

It is another object of the present invention to provide a continuous ink jet printing method that prevents ink drop misdirection which may be used in a asymmetric heat-type printer without the need for making structural changes in such a printer.

Both of these objects are realized by the method of the invention, which generally comprises the step of applying a deflection correcting heat pulse from a second heating element that is disposed opposite to the first heating element after the first heating element generates its last operational heat pulse.

While the deflection correcting heat pulse may be of the same duration and magnitude as the operational heat pulses generated by the first heating element, the duration is preferably slightly longer in the preferred embodiment. The deflection correcting heat pulse is preferably generated at a time period that substantially corresponds to one wave length of the electrical pulse frequency, ±50%.

While the second heating element must generate at least one deflection correcting heat pulse after the first heating element has generated its last operational heat pulse, it is within the scope of the invention that the second heating element may subsequently generate a second and a third deflection correcting heat pulse.

The specific power level and frequency of the electrical pulses used to drive the first and second heating elements will vary with the particular model of printer. Typically, each of the heat generating electrical pulses may have a voltage of between 4 and 6 volts, and a current of 8 and 12 milliamps. Additionally, the period of pulse generation may be between 5 and 7 microseconds.

BRIEF DESCRIPTION OF THE DRAWINGS

In the detailed description of the preferred embodiments of the invention presented below reference is made to the accompanying drawings in which:

FIG. 2(*b*) is a plan view of nozzle having a pair of heating elements disposed on opposite sides thereof.

DETAILED DESCRIPTION OF THE INVENTION

The inventive method is implemented by a continuous ink jet printer system that uses an asymmetric application of heat around an ink jet nozzle to achieve a desired ink drop deflection. In order for the method to be concretely understood, a description of the ink jet printer system 1 that carries out the method steps will first be given.

Figure 1:
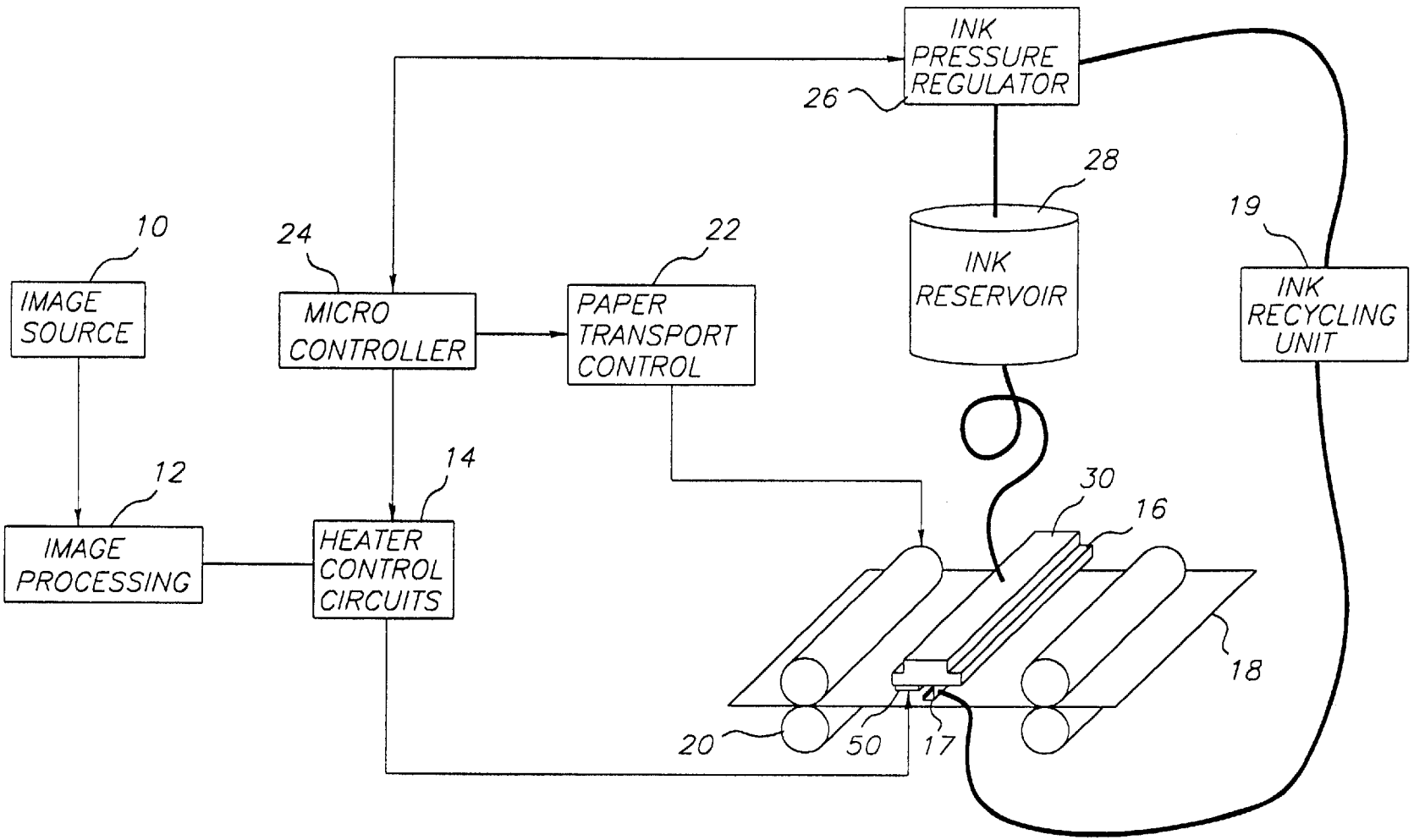
FIG. 1 is a simplified block schematic diagram of one exemplary printing apparatus capable of implementing the present invention.

Referring to FIG. 1, an asymmetric heat-type continuous ink jet printer system 1 includes an image source 10 such as a scanner or computer which provides raster image data, outline image data in the form of a page description language, or other forms of digital image data. This image data is converted to half-toned bitmap image data by an image processing unit 12 which also stores the image data in memory. A heater control circuit 14 reads data from the image memory and applies electrical pulses to a heater 50 that applies heat to a nozzle that is part of a printhead 16. These pulses are applied at an appropriate time, and to the appropriate nozzle, so that drops formed from a continuous ink jet stream will print spots on a recording medium 18 in the appropriate position designated by the data in the image memory.

Recording medium 18 is moved relative to printhead 16 by a recording medium transport system 20 which is electronically controlled by a recording medium transport control system 22, and which in turn is controlled by a microcontroller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 (also shown in FIG. 2(*a*)) that blocks the stream and which may allow a portion of the ink to be recycled by an ink recycling unit 19. The ink recycling unit 19 reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface where a plurality of nozzles and heaters are situated. With printhead 16 fabricated from silicon, it is possible to integrate heater control circuits 14 with the printhead.

Figure 2A:
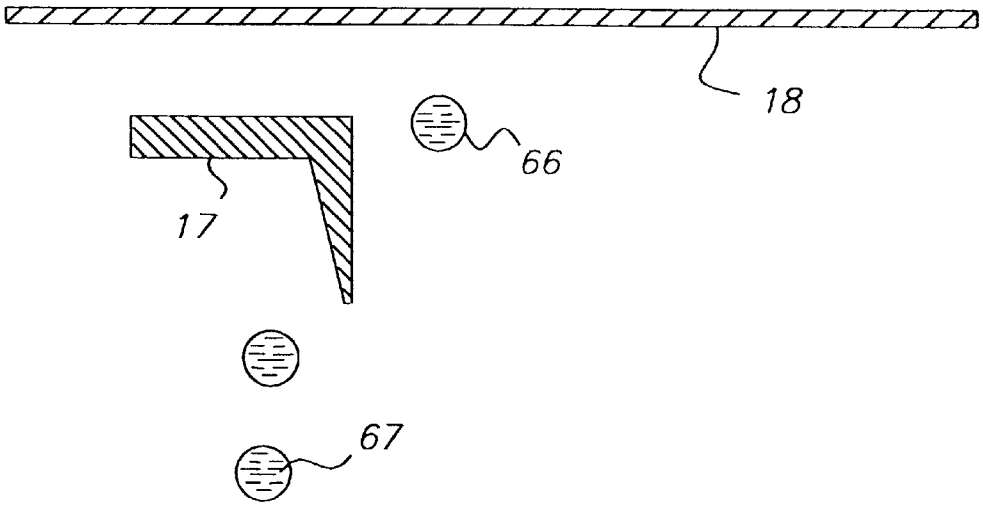
FIG. 2(*a*) is a cross sectional view of a nozzle with asymmetric heating deflection in operation.
Figure 2A:
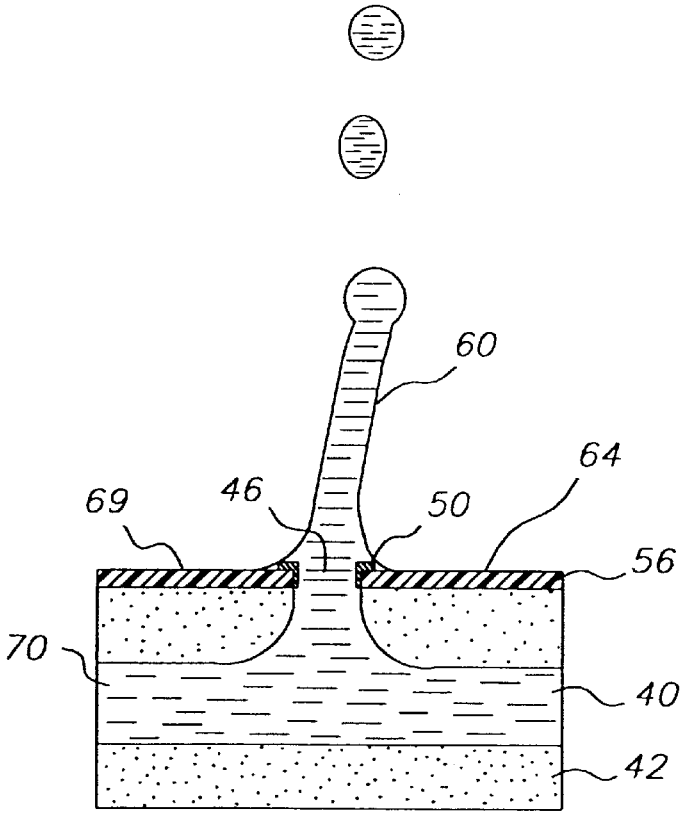
Figure 2B:
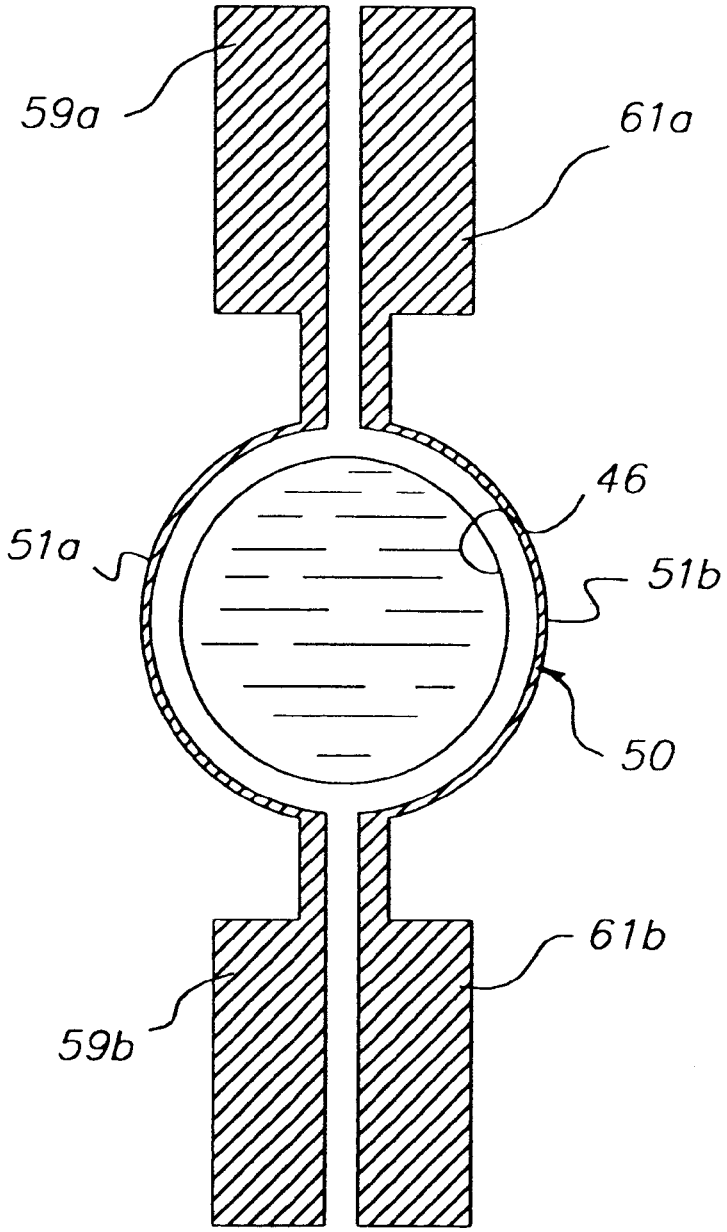
Figure 3B:
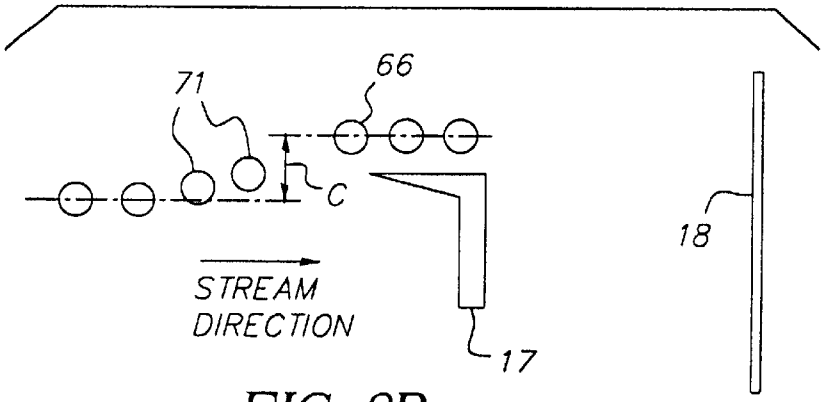
FIG. 3(*a*) through 3(*b*) illustrate the difference in trajectory of terminally discharged droplets when the method is not used and when the method is used, and FIGS. 4(*a*) and 4(*b*) illustrate the electrical pulse trains conducted through the opposing heating elements of the printer to implement the method of the invention.
Figure 3D:
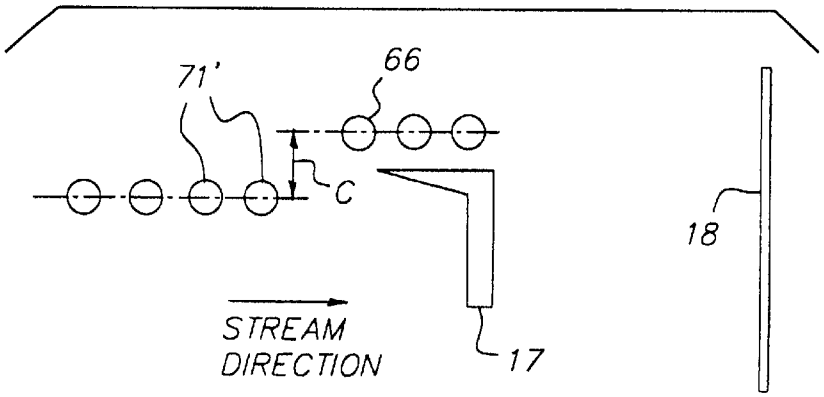
Figure 3A:
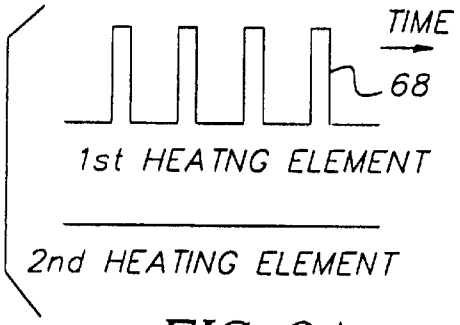
Figure 3C:
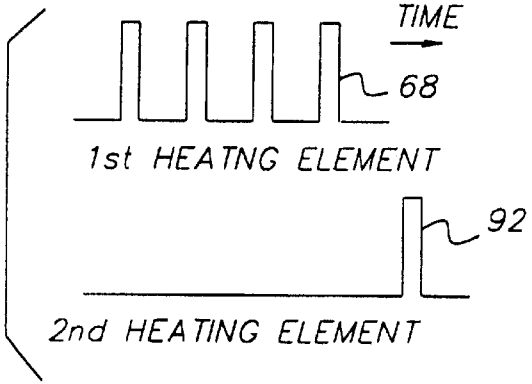

FIG. 2(*a*) is a cross-sectional view of a tip of a nozzle in operation. An array of such nozzles form the continuous ink jet printhead 16 of FIG. 1. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to heat supplied by a heater 50.

With reference now to FIG. 2(*b*), the heater 50 has a pair of opposing semicircular elements 51*a*, 51*b* covering almost all of the nozzle perimeter. In both embodiments, power connections 59*a*, 59*b*, 61*a*, and 61*b* transmit electrical pulses from the drive circuitry 14 to the heating elements 51*a*, 51*b*, respectively. Stream 60 is periodically deflected during a printing operation by the asymmetric application of heat generated on the left side of the nozzle bore by the heater section 51*a*. This technology is distinct from that of electrostatic continuous stream deflection printers which rely upon deflection of charged drops previously separated from their respective streams. With stream 60 being deflected, undeflected drops 67 may be blocked from reaching recording medium 18 by a cut-off device such as an ink gutter 17. In an alternate printing scheme, ink gutter 17 may be placed to block deflected drops 66 so that undeflected drops 67 will be allowed to reach recording medium 18.

The heating elements 51*a*, 51*b* of heater 50 may be made of polysilicon doped at a level of about 30 ohms/square, although other resistive heater materials could be used. Heater 50 is separated from substrate 42 by thermal and electrical insulating layer 56 to minimize heat loss to the substrate. The nozzle bore 46 may be etched allowing the nozzle exit orifice to be defined by insulating layers 56. The layers in contact with the ink can be passivated with a thin film layer 64 for protection. The printhead surface can be coated with a hydro-phobizing layer 69 to prevent accidental spread of the ink across the front of the printhead.

Heater control circuit 14 supplies electrical power to the heater 50 as shown in FIG. 2(*a*) in the form of electrical pulse trains. Control circuit 14 may be programmed to separately supply power to the semicircular heating elements 51*a*, 51*b* of the heater 50 in the form of pulses of uniform amplitude, width, and frequency to implement the steps of the inventive method. Deflection of an ink droplet occurs whenever an electrical power pulse is supplied to one of the elements 51*a*, 51*b* of the heater 50.

FIGS. 3(*a*) and 3(*b*) illustrate a series of deflected droplets 66 produced by previously discussed nozzle at the end of a printing operation when only the left-hand heating element 51*a* is used. The train of electrical pulses that periodically activate the heating element 51*a* are shown to the left of the droplet stream. These pulses operate to successfully deflect the droplets 66 away from the gutter 17 and into the printing medium 18. However, after the last operational pulse 68 has been conducted through the heating element 51*a*, the residual heat present in the materials defining the left-hand side of the nozzle bore 46 and the residual heat present in the ink causes a partial deflection of at least the first, and possibly second and third of the subsequent droplets toward the printing medium 18. The desired clearance "c" between droplets intended to strike the printing medium 18 vs. the gutter 17 is not maintained. As is evident in FIGS. 3(*a*) and 3(*b*), the first of the partially deflected droplets 71 following the last operational pulse 68 will likely strike either the printing medium, or the leading edge of the gutter 17 causing the partially deflected droplets 71 to break into smaller droplets (spatter) and strike the recording media 18 in an unpredictable manner. It is possible for the second and third of the partially deflected droplets 71 to likewise spatter on the edge of the gutter. In any case, image quality will suffer.

FIGS. 3(*c*) and 3(*d*) illustrate a series of undeflected drops 71' produced by the electrical pulses shown on the left-hand side of this figure which are generated in accordance with the method of the invention. In this example, a deflection correcting pulse 92 of the same voltage and current is conducted through the right-hand heating element 51*b* shortly after the last operational pulse 68 is conducted through the left-hand heating element 51*a*. The addition of the resulting heat pulse to the opposite side of the nozzle bore 46 counteracts the residual heat present in the side of the nozzle generated by the heating element 51*a*, causing all the droplets 71' to follow an undeflected path directly into the gutter 17, thereby maintaining the desired clearance "c" between deflected and undeflected drops. Various electrical parameters of the pulse or pulses conducted through the heating element 51*b* are discussed hereinafter.

Figure 4B:
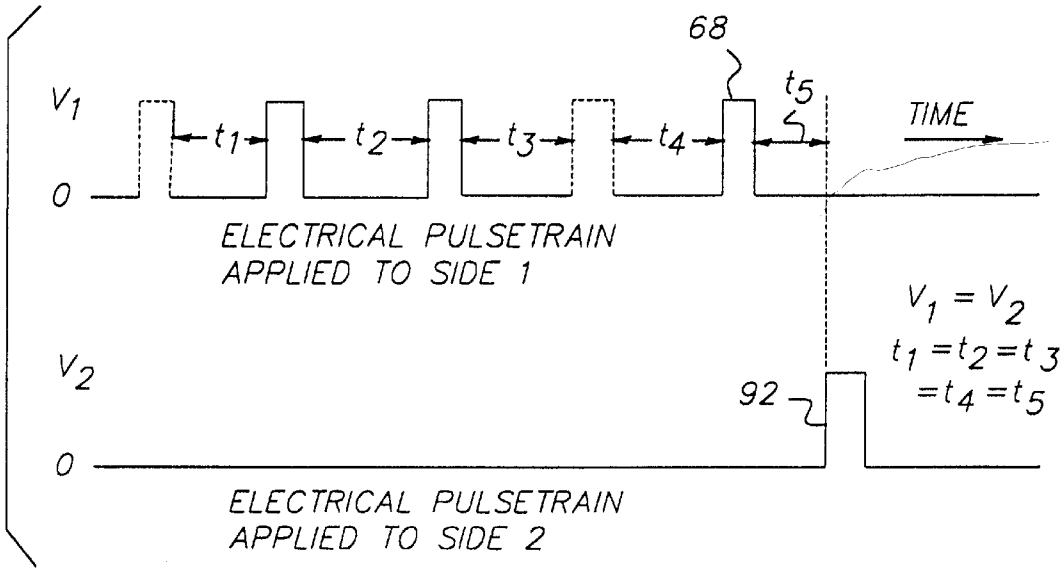
Figure 4A:
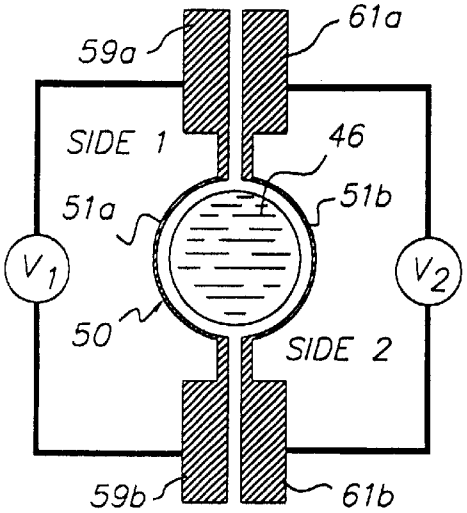

FIGS. 4(*a*) and 4(*b*) illustrate both the electrical parameters of the pulses as well as the relationship between the operational pulses and the deflection correcting pulse. Specifically, the operational pulses typically have an amplitude of between 4 and 6 volts, and a current of approximately 10 milliamps. These pulses may be generated at the end or at the beginning of uniform time periods $t_1$, $t_2$, $t_3$ and $t_4$. The time period may range between 5 and 10 microseconds. FIGS. 4(*a*) and 4(*b*) illustrate that, when the last operational pulse 68 is generated, a deflection correcting pulse 92 is generated which will flow through the opposing heater element 52*b* and generate a correcting heat pulse in the manner previously described. The deflection correcting pulse 92 is preferably about the same voltage and amperage as the operational pulses, and of slightly longer duration as indicated. The deflection correcting pulse 92 may be generated at a time period $t_5$ that is the same as the time periods $t_1$, $t_2$, $t_3$ and $t_4$ for the generation of pulses through heating element 51*a*. Alternatively, the time period $t_5$ may be as much as 50% longer or shorter than the other time periods. In the present practice, the deflection correcting pulses 92 is generated after the last operational pulse 68 after between about 4 and 10 microseconds.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

The invention has been described in detail with particular reference to preferred embodiments thereof, but it will be understood that variations and modifications can be effected within the spirit and scope of the invention.

PARTS LIST

1. Printer system
10. Image source
12. Image processing unit
14. Heater control circuit
16. Printhead
17. Ink gutter
18. Recording medium
19. Ink recycling unit
20. Transport system
22. Transport control system
24, Micro-controller
26. Ink jet pressure regulator
28. Ink reservoir
30. Ink channel device
40. Ink delivery channel
42. Substrate
46. Nozzle bores
50. Nozzle heater
51. Meniscus
56. Electrical insulating layer
59. Connector
60. Stream
61. Connector
64. Thin passivation film
66. Deflected drops
67. Undeflected drops
68. Last operational pulse
69. Hydrophobizing layer
70. Ink
71. Partially deflected drops
92. Deflection correction pulse

What is claimed:

1. A method for controlling a terminal flow of ink droplets from a nozzle of an ink jet printer at an end of a printing operation, wherein the printer has a heating element adjacent one side of said nozzle that is selectively actuated to direct said ink droplets toward a recording medium and away from an ink gutter, comprising the step of:

applying heat on a side of said nozzle opposite from said heating element at the end of said printing operation.

2. The method defined in claim 1, wherein said heat is applied to said opposite side of said nozzle in a form of at least one heat pulse.

3. The method defined in claim 2, wherein said heat is applied to said opposite side of said nozzle in a form of no more than three sequential heat pulses.

4. The method of defined in claim 2, wherein said heating element is a first heating element, said printer including a second heating element, said first and second heating elements being positioned on either side of said nozzle, each of said first and second heating elements generating a heat pulse when an electrical pulse is conducted through it.

5. The method defined in claim 4, wherein said first heating element is selectively actuated at one of a sequence of uniform time periods to selectively direct said ink droplets toward said recording medium and away from said ink gutter.

6. The method defined in claim in claim 5, wherein said second heating element is actuated to apply a deflection correcting heat pulse to said opposite side of said nozzle after said first heating element applies a last operational heat pulse to said nozzle.

7. The method defined in claim 6, wherein said second heating element applies said deflection correcting heat pulse immediately after one of said uniform time periods.

8. The method defined in claim 6, wherein said deflection correcting heat pulse is of substantially the same or greater duration and magnitude as said last operational heat pulse.

9. The method defined in claim 6, wherein a voltage of the electrical pulses that generate the deflection correcting heat pulse and the last operational heat pulse is between about 4 and 6 volts.

10. The method defined in claim 5, wherein said uniform time periods are between about 5 to 7 microseconds.

11. A method of controlling a terminal flow of ink droplets from a nozzle of an ink jet printer at an end of a printing operation, wherein the printer has first and second heating elements disposed on opposite sides of said nozzle, wherein said first heating element is periodically actuated to direct said ink droplets toward a recording medium and away from an ink gutter, comprising the step of:

actuating said second heating element after said first heating element applies a last operational heat pulse to said nozzle at the end of said printing operation.

12. The method defined in claim 11, wherein said second heating element applies between 1 and 3 heat pulses to said opposite side of said nozzle.

13. The method defined in claim 12, wherein all of said heat pulses are generated by electrical pulses having substantially the same voltage and current.

14. The method defined in claim 13, wherein said first heating element is actuated at one of a sequence of uniform time periods, and wherein a deflection correcting heat pulse is generated by said second heating element at one time period after the first heating element generates said last operational heat pulse.

15. The method defined in claim 14, wherein said deflection correcting heat pulse and said last operational heat pulse are generated by an electrical pulse, said electrical pulse having at least one of a voltage of between 4 and 6 volts, a current between 8 and 12 milliamps, and a time period of between about 4 to 7 microseconds.

* * * * *